US008437672B2

(12) United States Patent
Watanabe et al.

(10) Patent No.: US 8,437,672 B2
(45) Date of Patent: May 7, 2013

(54) SEPARATION UNIT, FIXING UNIT AND IMAGE FORMING APPARATUS

(75) Inventors: Sho Watanabe, Kanagawa (JP); Junichi Ichikawa, Kanagawa (JP); Junpei Amano, Kanagawa (JP); Aya Kakishima, Kanagawa (JP); Masaya Nakatsuhara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 261 days.

(21) Appl. No.: 12/892,247

(22) Filed: Sep. 28, 2010

(65) Prior Publication Data

US 2011/0081173 A1 Apr. 7, 2011

(30) Foreign Application Priority Data

Oct. 2, 2009 (JP) ..... 2009-230586
Sep. 2, 2010 (JP) ..... 2010-196848

(51) Int. Cl.
*G03G 15/20* (2006.01)

(52) U.S. Cl.
USPC ..... 399/323

(58) Field of Classification Search ..... 399/323, 399/320, 329; 219/216, 469–471
See application file for complete search history.

(56) References Cited

U.S. PATENT DOCUMENTS

| | | | | |
|---|---|---|---|---|
| 2007/0048035 | A1* | 3/2007 | Baba et al. | 399/323 |
| 2007/0048042 | A1* | 3/2007 | Uehara et al. | 399/329 |
| 2009/0116885 | A1* | 5/2009 | Ando | 399/329 |
| 2011/0064491 | A1* | 3/2011 | Kono et al. | 399/329 |

FOREIGN PATENT DOCUMENTS

| | | | |
|---|---|---|---|
| JP | A-05-088571 | | 4/1993 |
| JP | A-2003-217816 | | 7/2003 |
| JP | A-2007-065092 | | 3/2007 |
| JP | 2007108405 | A * | 4/2007 |
| JP | A-2007-086530 | | 4/2007 |
| JP | A-2007-114698 | | 5/2007 |
| JP | A-2007-171842 | | 7/2007 |
| JP | A-2007-193121 | | 8/2007 |
| JP | A-2008-233232 | | 10/2008 |

OTHER PUBLICATIONS

Office Action issued in Australian Patent Application No. 2010226871 dated Jul. 18, 2011.

* cited by examiner

*Primary Examiner* — Susan Lee
(74) *Attorney, Agent, or Firm* — Oliff & Berridge, PLC

(57) ABSTRACT

A separation unit is provided on a downstream side of a contact area between a belt-like rotating body and a pressure rotating body. The separation unit includes a pressure member, a guide portion and a pressure portion. The pressure member extends along a width direction of the belt-like rotating body, and presses the belt-like rotating body to deform the belt-like rotating body into a bent shape changing a course away from a surface of the pressure rotating body. The guide portion is on the pressure rotating body side of the pressure member to guide the belt-like rotating body so that an angle portion of the bent shape bites into the pressure rotating body. The pressure portion is on the surface in the pressure rotating body side, and the surface separates sequentially from the pressure rotating body in the extending direction from a center portion to an end portion.

12 Claims, 16 Drawing Sheets

EXAMPLE

COMPARATIVE EXAMPLE

SEPARATION UNIT, FIXING UNIT AND IMAGE FORMING APPARATUS

CROSS-REFERENCE TO RELATED APPLICATION

This application is based on and claims priority under 35 USC 119 from Japanese Patent Application Nos. 2009-230586 filed on Oct. 2, 2009, and 2010-196848 filed on Sep. 2, 2010.

BACKGROUND

Technical Field

The present invention relates to a separation unit, a fixing unit using the separation unit, and an image forming apparatus using the fixing unit.

SUMMARY

[1] According to an aspect of the invention, a separation unit is provided on a downstream side of a contact area between a belt-like rotating body and a pressure rotating body disposed in contact with the belt-like rotating body so as to apply elastic pressure thereto, and separates a recording material disposed adjacently to the contact area inside the belt-like rotating body and adhering to the belt-like rotating body. The separation unit includes a pressure member, a guide portion and a pressure portion. The pressure member is provided to extend along a width direction of the belt-like rotating body. The width direction crosses a moving direction of the belt-like rotating body. The pressure member presses the belt-like rotating body so as to deform the belt-like rotating body into a bent shape changing a course of the belt-like rotating body away from a surface of the pressure rotating body after the belt-like rotating body is disposed in contact with the pressure rotating body. The guide portion is provided on the pressure rotating body side of the pressure member and guides the belt-like rotating body so that an angle portion of the bent shape of the belt-like rotating body bites into the pressure rotating body. The pressure portion is provided on the surface of the pressure member in the pressure rotating body side. The pressure portion is provided so that the surface of the pressure rotating body separates sequentially from the pressure rotating body in the extending direction of the pressure member from a center portion of the pressure portion to an end portion of the pressure portion.

BRIEF DESCRIPTION OF THE DRAWINGS

Exemplary embodiments of the invention will be described in detail based on the following figures, wherein.

DETAILED DESCRIPTION

Outline of Embodiment

Figure 1A:
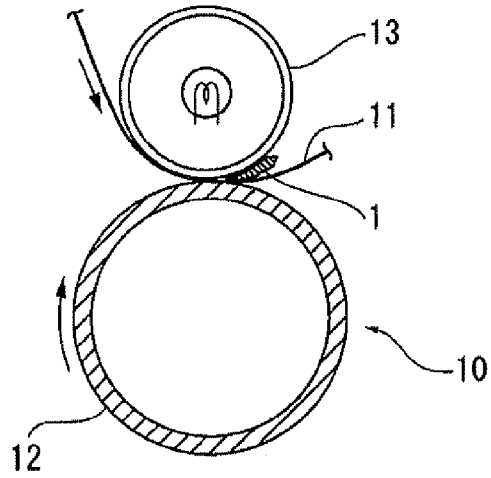
FIG. 1A is an explanatory view showing the outline of an embodiment of a fixing unit to which the invention is applied.

FIG. 1A is an explanatory view showing the outline of an embodiment of a fixing unit to which the invention is applied. A fixing unit of this type is used, for example, in an image forming apparatus using an electrophotographic system.

In this case, the image forming apparatus has a toner image forming unit which forms an unfixed toner image on a recording material, and a fixing unit which fixes the unfixed toner image formed on the recording material by the toner image forming unit.

In FIG. 1A, a fixing unit 10 has a belt-like heating rotating body (corresponding to a belt-like rotating body) 11, a pressure rotating body 12 and a separation unit 1. The heating rotating body 11 rotates while at least its surface is heated. The pressure rotating body 12 is brought into pressure contact with the surface of the heating rotating body 11 so as to roll together with the heating rotating body 11 while holding and conveying a recording material between the pressure rotating body 12 and the heating rotating body 11. Thus, an unfixed toner image on the recording material is heated and pressurized to be fixed. The separation unit 1 separates the recording material adhering to at least the heating rotating body 11.

In FIG. 1A, the reference numeral 13 represents a heating source for heating the heating rotating body 11 while holding and conveying the heating rotating body (belt-like rotating body) 11 between the heating source 13 and the pressure rotating body 12. The system for heating the heating rotating body 11 is not limited thereto. It is a matter of course that another suspension member for suspending and conveying the heating rotating body 11 in a tensioned state or another heating member disposed in contact or non-contact with the heating rotating body may be used as the heating source.

Figure 1B:
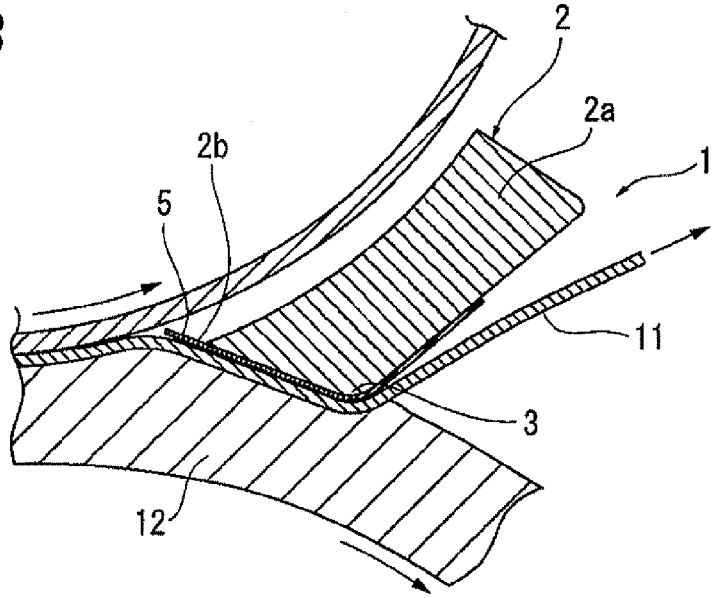
FIG. 1B is an explanatory view showing a main portion of a separation unit in the fixing unit.
Figure 1C:
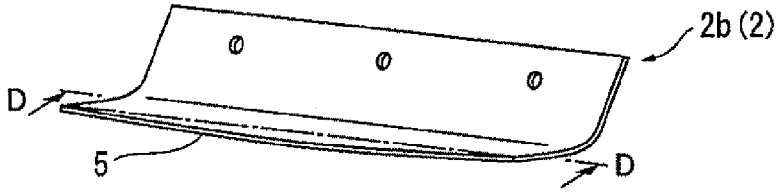
FIG. 1C is a perspective view showing a separation member in FIG. 1B.
Figure 1D:
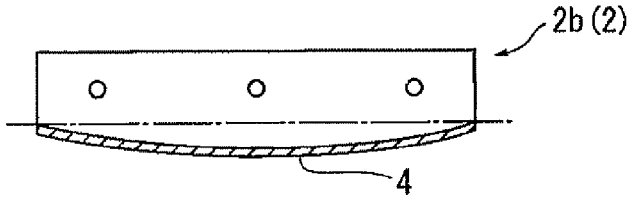
FIG. 1D is a sectional view taken on line D-D in FIG. 1C.

In this embodiment, as shown in FIGS. 1B-1D, the separation unit 1 is provided on a downstream side of a contact area between a belt-like rotating body 11 and a pressure rotating body 12 which is disposed in contact with the belt-like rotating body 11 so as to apply elastic pressure thereto. The separation unit 1 separates a recording material disposed adjacently to the contact area inside the belt-like rotating body 11 and adhering to the belt-like rotating body 11. The separation unit 1 includes a pressure member 2, a guide portion 3 and a pressure portion 4. The pressure member 2 is provided to extend along a width direction of the belt-like rotating body 11. The width direction crosses a moving direction of the belt-like rotating body 11. The pressure member 2 presses the belt-like rotating body 11 so as to deform the belt-like rotating body 11 into a bent shape changing a direction of the belt-like rotating body 11 away from a surface of the pressure rotating body 12 after the belt-like rotating body 11 is disposed in contact with the pressure rotating body 12. The guide portion 3 is provided on the pressure rotating body 12 side of the pressure member 2 and guides the belt-like rotating body 11 so that an angle portion of the bent shape of the belt-like rotating body 11 bites into the pressure rotating body 12. The pressure portion 4 is provided on a surface of the pressure member 2 in the pressure rotating body 12 side. The pressure portion 4 is provided so that the surface of the pressure member 2 separates sequentially from the pressure rotating body 12 in the extending direction of the pressure member 2 from a center portion of the pressure portion 4 to an end portion of the pressure portion 4.

In such technical means, the pressure member 2 may have a supported member 2*a* and a separation member 2*b* separated from each other as will be described later, or integrated with each other.

The guide portion 3 may be suitably selected as long as an angle portion of the bent shape of the belt-like rotating body 11 can bite into the pressure rotating body 12. It will go well if the guide portion 3 is provided in consideration of the relative position relationship between the mounting position of the pressure member 2 and the pressure rotating body 12.

Further, it will go well if the pressure portion 4 is formed so that a surface of the pressure member 2 in a side of the pressure rotating body 12 separates sequentially from the pressure rotating body 12 in the extending direction of the pressure member 2 from the center portion of the pressure portion 4 to the end portion of the pressure portion 4. On this occasion, due to the center portion which thrusts compared to the end portion, the distribution of pressure on the recording material is increased in a separation portion corresponding to the center portion so that a shortage of pressure in the center portion due to bending or the like of the pressure member 2 can be compensated.

In another respect, the pressure portion 4 is formed so that the surface of the pressure member 2 on the side of the pressure rotating body 12 thrusts sequentially towards the side of the pressure rotating body 12 in the extending direction of the pressure member 2 from the end portion of the pressure portion 4 to the center portion of the pressure portion 4.

Next, a representative mode or a preferred mode of the separation unit 1 will be described.

First, according a preferred mode of the separation unit 1, from the viewpoint of keeping the pressure distribution by the pressure member 2 better, a protrusion portion 5 may be further provided on the pressure rotating body 12 side of the pressure member 2 and on the contact area side between the belt-like rotating body 11 and the pressure rotating body 12. The protrusion portion 5 protrudes in a convex shape in which a center portion thereof is more protrusive toward the contact area than any of opposite end portions thereof with respect to a crossing direction crossing the moving direction of the belt-like rotating body 11.

The protrusion portion 5 mentioned herein does not have to be formed into a curved shape. The protrusion portion 5 may be formed into a mountain-like shape or any other shape may be suitably selected as long as the center portion thereof is protrusive.

On the other hand, according to a representative mode of the pressure member 2, the pressure member 2 may be constituted by a supported member 2*a* and a separation member 2*b*. The supported member 2*a* is supported on a predetermined support portion. The separation member 2*b* is provided along a contact plane between the supported member 2*a* and the belt-like rotating body 11. According to this mode, the guide portion 3 and the pressure portion 4 may be formed in advance in the separation member 2*b* which has, for example, a plate-like shape so that the separation member 2*b* can be fixedly attached to the supported member 2*a*.

Further, the structure to support the pressure member 2 configured thus may be selected suitably. From the viewpoint of uniquely deciding the position where the pressure member 2 is disposed, there is a preferable mode in which the pressure member 2 is fixedly supported through a support member (not shown) to a holding member (not shown) which can be held by the belt-like rotating body 11.

Furthermore, from the viewpoint of reducing the contact resistance with the belt-like rotating body, a contact surface of the pressure member 2 with the belt-like rotating body 11 preferably has a lubricating layer which can reduce a frictional force between the contact surface and the belt-like rotating body 11.

Indeed any mode can be used for the guide portion 3 as long as the mode can bite into the pressure rotating body 12, but from the viewpoint of stabilizing the state where the belt-like rotating body bites into the pressure rotating body 12, there is a preferable mode in which the angle portion of the bent shape of the belt-like rotating body 11 has a curved portion with a large curvature and the guide portion 3 makes the belt-like rotating body 11 bite into the pressure rotating body 12 so that the curved portion of the belt-like rotating body 11 can be buried therein.

Further, in another embodiment, the separation unit 1 is provided on the downstream side of a contact area between a belt-like rotating body 11 and a pressure rotating body 12 which is disposed in contact with the belt-like rotating body 11 so as to apply elastic pressure thereto. The separation unit 1 separates a recording material disposed adjacently to the contact area inside the belt-like rotating body 11 and adhering to the belt-like rotating body 11. The separation unit 1 has a pressure member 2, a guide portion 3 and a protrusion portion 5. The pressure member 2 is provided to extend along a width direction of the belt-like rotating body. The width direction crosses a moving direction of the belt-like rotating body 11. The pressure member 2 presses the belt-like rotating body 11 so as to deform the belt-like rotating body 11 into a bent shape changing the direction of the belt-like rotating body 11 away from the surface of the pressure rotating body 12 after the belt-like rotating body 11 is disposed in contact with the pressure rotating body 12. The guide portion 3 is provided on the pressure rotating body 12 side of the pressure member 2 to guide the belt-like rotating body 11 so that an angle portion of the bent shape of the belt-like rotating body 11 bites into the pressure rotating body 12. The protrusion portion 5 is provided on the pressure rotating body 12 side of the pressure member 2 and on the contact area side between the belt-like rotating body 11 and the pressure rotating body 12, so as to protrude in a convex shape in which a center portion thereof is more protrusive toward the contact area than any of opposite end portions thereof with respect to a crossing direction crossing the moving direction of the belt-like rotating body 11.

According to this mode, a shortage of pressure in the center portion of the distribution of pressure on the recording material in a separation portion where the recording material is separated on the downstream side of the contact area between the belt-like rotating body 11 and the pressure rotating body 12 can be compensated due to the guide portion 3 of the pressure member 2 as a component of the separation unit 1 by which the belt-like rotating body 11 can bite into the pressure rotating body 12, and the protrusion portion 5 by which the contact area can be increased in the center portion.

Here, according to a preferred mode of the protrusion portion 5, from the viewpoint of flattening creases which may be generated in the recording material, the protrusion portion 5 may be formed to be symmetrical with respect to the center portion in the crossing direction and to be curved.

In addition, from the viewpoint of preventing the belt-like rotating body 11 from being caught on the tip of the protrusion portion 5, it is preferable that the protrusion portion 5 is formed to have a sectionally curved tip.

First Embodiment

Figure 2:
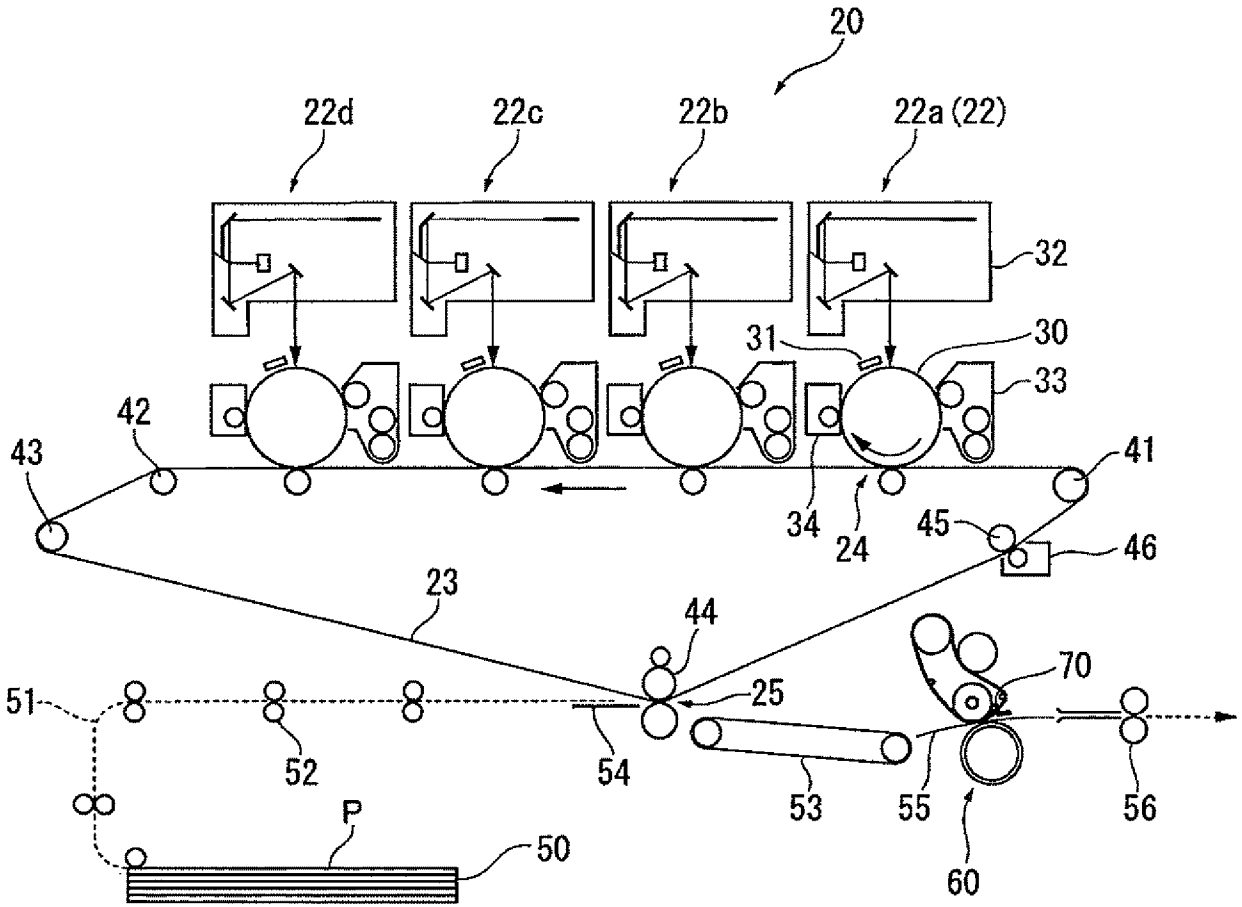
FIG. 2 is an explanatory view showing an overall configuration of an image forming apparatus according to a first embodiment.

FIG. 2 is an explanatory view showing a first embodiment of an image forming apparatus to which the invention is applied.

In FIG. 2, an image forming apparatus 20 is an image forming apparatus of a so-called tandem type intermediate transfer system, including a plurality of image forming portions 22 (22*a* to 22*d*) by which toner images of respective color components (four colors of yellow (Y), magenta (M), cyan (C) and black (K) in this embodiment) can be formed in an electrophotographic system. A belt-like intermediate transfer member 23 is disposed in a portion corresponding to the image forming portions 22, while primary transfer units 24 (for example, primary transfer rolls) are disposed on the back side of the intermediate transfer member 23 correspondingly to the image forming portions 22 respectively. Further, a secondary transfer unit (for example, secondary transfer roll) 25 is disposed in a portion of the intermediate transfer member 23. Color component toner images primarily transferred on the intermediate transfer member 23 from the image forming portions 22 respectively by the primary transfer units 24 are secondarily transferred onto a sheet of paper P as a recording material by the secondary transfer unit 25. A fixing unit 60 is disposed on the conveyance-direction downstream side of the sheet of paper P on which the respective color component toner images have been transferred. By the fixing unit 60, the unfixed toner images on the sheet of paper P are fixed.

Here, each image forming portion 22 has a drum-like photoconductor 30 rotating in a predetermined direction. A charging unit 31, an exposure unit 32 such as a laser scanning unit, a developing unit 33 and a cleaning unit 34 are provided around the photoconductor 30. The charging unit 31 charges the photoconductor 30. The exposure unit 32 writes an electrostatic latent image on the photoconductor 30 charged by the charging unit 31. The electrostatic latent image written on the photoconductor 30 by the exposure unit 32 is developed with a corresponding color toner by the developing unit 33. The cleaning unit 34 cleans a residue on the photoconductor 30 after the toner image developed by the developing unit 33 has been primarily transferred onto the intermediate transfer member 23 by the primary transfer unit 24.

In addition, the intermediate transfer member 23 is suspended on a plurality of suspension rolls 41-45. For example, the suspension roll 41 is circulated and rotated in a predetermined direction as a driving roll. The suspension roll 44 also serves as an opposed roll to the secondary transfer roll as the secondary transfer unit 25 so as to generate a secondary transfer electric field required for secondary transfer between the secondary transfer roll and the opposed roll. Further, an intermediate transfer cleaning unit 46 is disposed in the surface of the intermediate transfer member 23 corresponding to the suspension roll 45.

Further, a paper feed unit 50 is provided under the intermediate transfer member 23. A sheet of paper P supplied from the paper feed unit 50 is conveyed along a conveyance path 51 to the fixing unit 60 through the secondary transfer unit 25. A proper number of conveyance rolls 52, a conveyance belt 53, guide plates 54 and 55, a discharge roll 56, etc. are provided in the conveyance path 51. The conveyance belt 53 conveys the sheet of paper P from the secondary transfer unit 25 to the fixing unit 60. By each guide plate 54, 55, the sheet of paper P is guided to a secondary transfer portion of the secondary transfer unit 25 or a fixing portion of the fixing unit. The discharge roll 56 is provided for discharging the sheet of paper P to a not-shown paper discharge portion.

Next, the fixing unit 60 used in this embodiment will be described with reference to FIG. 3.

Figure 3:
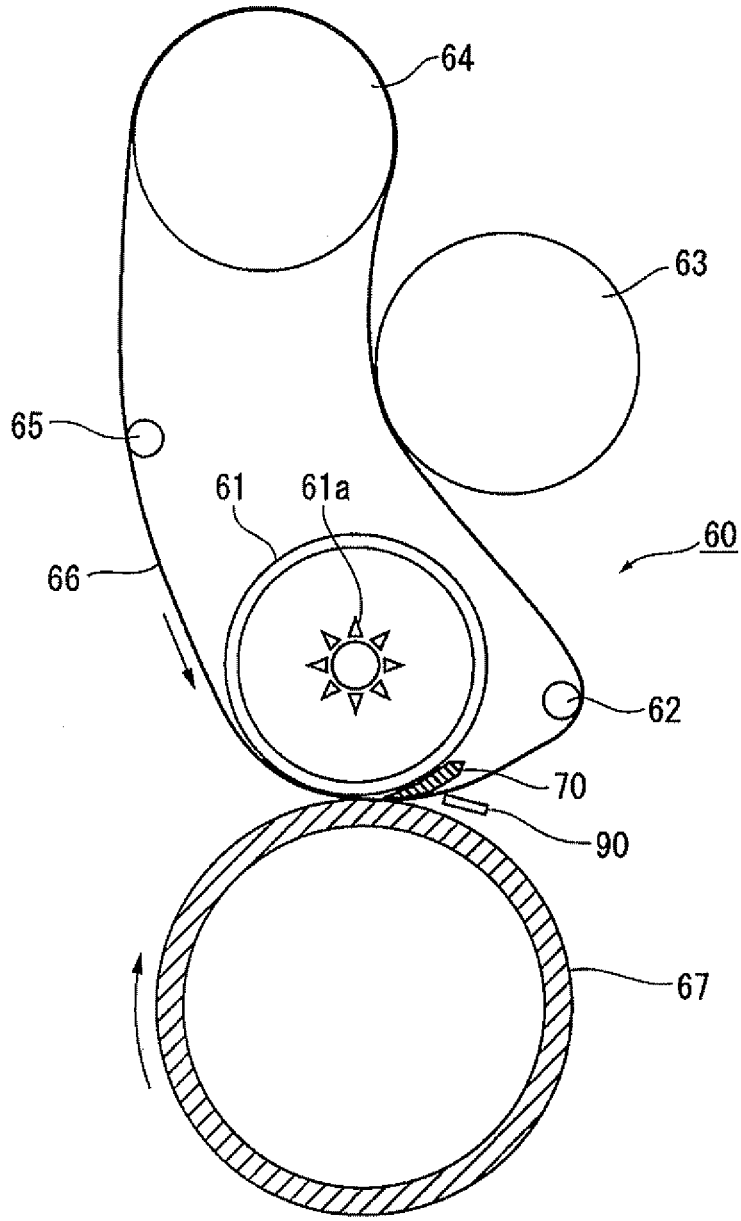
FIG. 3 is an explanatory view showing the details of a fixing unit used in the first embodiment.

In FIG. 3, the fixing unit 60 has a fixing roll 61, a heating belt 66, a pressure roll 67 and a separation unit 70. The fixing roll 61 includes a heat source 61*a* such as a halogen lamp. The heating belt 66 is suspended on the fixing roll 61 and a plurality of suspension rolls 62-65 so that the heating belt 66 circulates and moves while being heated. The pressure roll 67 pressurizes and conveys the heating belt 66 between the pressure roll 67 and the fixing roll 61. The separation unit 70 is provided on the downstream side of a nip area between the fixing roll 61 and the pressure roll 67 inside the heating belt 66 so as to separate the sheet of paper P which has been passed through the nip area.

Here, in this embodiment, the suspension rolls 62, 64 and 65 are disposed inside the heating belt 66 while the suspension roll 63 is disposed outside the heating belt 66 between the suspension rolls 62 and 64. In this embodiment, the fixing roll 61 is designed to have a heat source. In addition thereto or independently thereof, for example, a part of the suspension rolls 62-65 may also serve as assistant heating rolls each having a heat source if necessary.

In this embodiment, the fixing roll 61 has a cylindrical core coated with a protective layer, for example, of fluorinated resin or the like. The core is, for example, made from aluminum. For example, the pressure roll 67 has an aluminum core as a substrate, and an elastic layer of silicone rubber or the like and a release layer such as a PFA tube which are laminated on the substrate. Further, the heating belt 66 can be selected suitably. For example, the heating belt 66 has a base layer of polyimide resin or the like, and an elastic layer of silicone rubber or the like and a release layer (made of a PFA tube) which are laminated on the surface side of the base layer. Each suspension roll 62-65 is a metal roll which is, for example, made from aluminum.

In this embodiment, the separation unit 70 is provided so that the separation unit 70 extends along a width direction of the heating belt 66. The width direction crosses the moving direction of the heating belt 66. And, the separation unit 70 has a pressure pad (corresponding to a pressure member) 71 which presses the heating belt 66 to deform the heating belt 66 into a shape changing the direction of the heating belt 66 away from the surface of the pressure roll 67 after the heating belt 66 is disposed in contact with the pressure roll 67.

Figure 4:
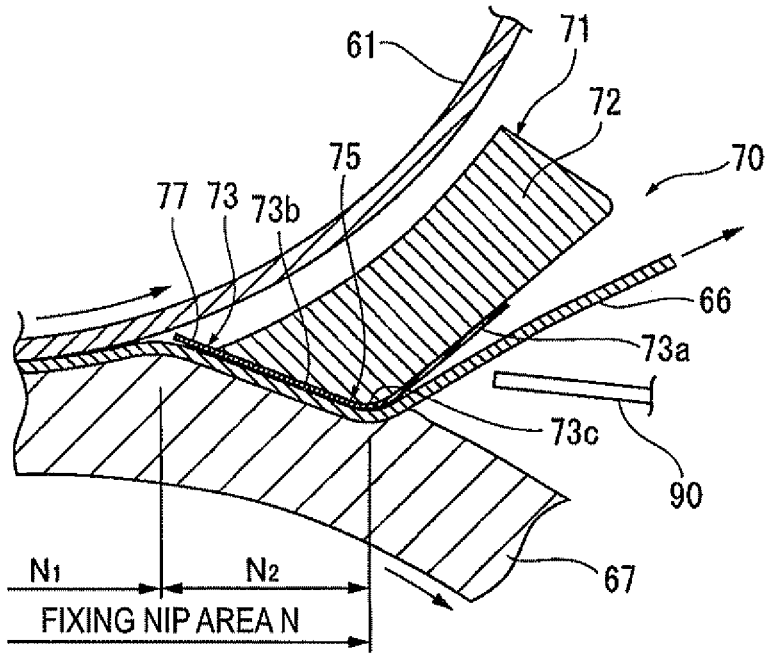
FIG. 4 is an explanatory view showing the details of a separation unit used in the first embodiment.
Figure 5A:
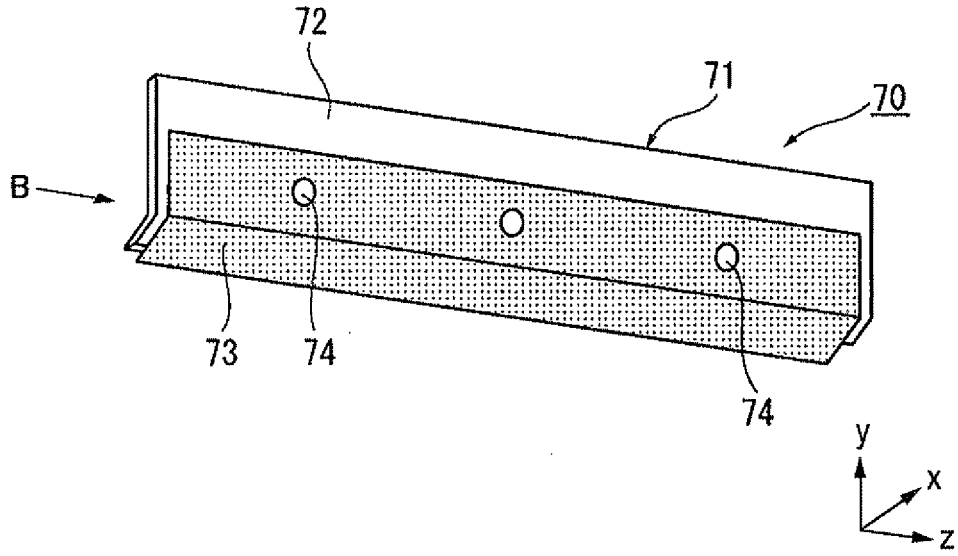
FIG. 5A is a perspective view showing a pressure pad of the separation unit.
Figure 5B:
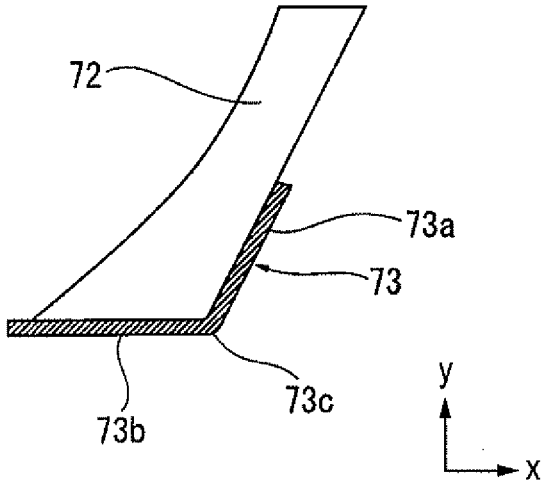
FIG. 5B is a view taken in the direction of the arrow B in FIG. 5A, which indicate the reference symbol X, Y and Z for three space axis directions (X axis direction, Y axis direction and Z axis direction) respectively in the drawings.

In this embodiment, as shown in FIG. 4 and FIGS. 5A-5B, the pressure pad 71 has a supported member 72 and a separation member 73. The supported member 72 is formed, for example, out of a rigid body of metal such as carbon steel, ceramics, or the like. The supported member 72 is supported on a predetermined support portion. The separation member 73 is provided along a contact surface of the supported member 72 with the heating belt 66. The separation member 73 is formed out of a rigid body of metal such as SUS or ceramics and substantially into a sectionally L-shape. The separation member 73 is fixedly attached to the supported member 72 by not-shown fastenings through a plurality of mounting holes 74. The mounting holes 74 are formed in a longitudinal wall portion 73*a* extending in the longitudinal direction of the separation member 73.

In this embodiment, the separation member 73 which is a component of the pressure pad 71 has a curved angle portion 73*e* in a sectionally L-shaped bent portion thereof, and a lateral wall portion 73*b* extends in the lateral direction of the separation member 73. The pressure pad 71 guides the heating belt 66 using the lateral wall portion 73*b* and the curved angle portion 73*c* as a guide portion 75 so as to make the heating belt 66 bite into the pressure roll 67.

In this embodiment, the guide portion 75 makes the heating belt 66 bite into the pressure roll 67 so that the bent portion of the heating belt 66 disposed and bent correspondingly to the curved angle portion 73*c* of the separation member 73 can be buried into the pressure roll 67.

Thus, in this embodiment, for example, as shown in FIG. 4, the heating belt 66 is disposed in contact with the pressure roll 67 in a nip area $N_1$ between the fixing roll 61 and the pressure roll 67 and a nip area $N_2$ between the pressure pad 71 and the pressure roll 67. After heating, pressurizing and conveying the sheet of paper P between the heating belt 66 and the pressure roll 67 over a fixing nip area N (specifically the nip area $N_1$ and the nip area $N_2$), the heating belt 66 leaves the pressure roll 67 in accordance with the shape of the curved angle portion 73*c* of the separation member 73 of the pressure pad 71 located on the exit side of the nip area $N_2$. Thus, the sheet of paper P can be separated easily in a portion corresponding to the curved angle portion 73*c* of the separation member 73 of the pressure pad 71 after passing through the fixing nip area N between the heating belt 66 and the pressure roll 67.

In addition, in this embodiment, in the separation member 73 which is a component of the pressure pad 71, a pressure portion 76 is provided so that a surface of the lateral wall portion 73*b* separates sequentially from the pressure roll 67 in a extending direction of the pressure pad 71 from a center portion of the pressure portion 76 to a end portion of the pressure portion 76. And, the pressure portion 76 presses the heating belt 66 toward the pressure roll 67, as shown in FIGS. 6A to 6D. A thrust quantity h (see FIG. 6D) of the pressure portion 76 on the pressure roll 67 side is set suitably in consideration of a shortage of pressure in a widthwise center portion of the sheet of paper P in the distribution of pressure applied by the pressure pad 71 in the nip area $N_2$.

Further, in this embodiment, the separation member 73 which is a component of the pressure pad 71 further has a protrusion portion 77 on the tip side of the lateral wall portion 73*b*, that is, on the side of the nip area $N_1$ between the fixing roll 61 and the pressure roll 67. The protrusion portion 77 is formed to protrude in a convex shape so that a center portion thereof is more protrusive toward the nip area $N_1$ than any of opposite end portions thereof with respect to a widthwise direction crossing the conveyance direction (corresponding to the process direction) of the sheet of paper P.

Particularly in this embodiment, the tip edge of the protrusion portion 77 is formed as a curved edge 78 which is symmetrical and curved around the widthwise center portion of the sheet of paper P.

Figure 13A:
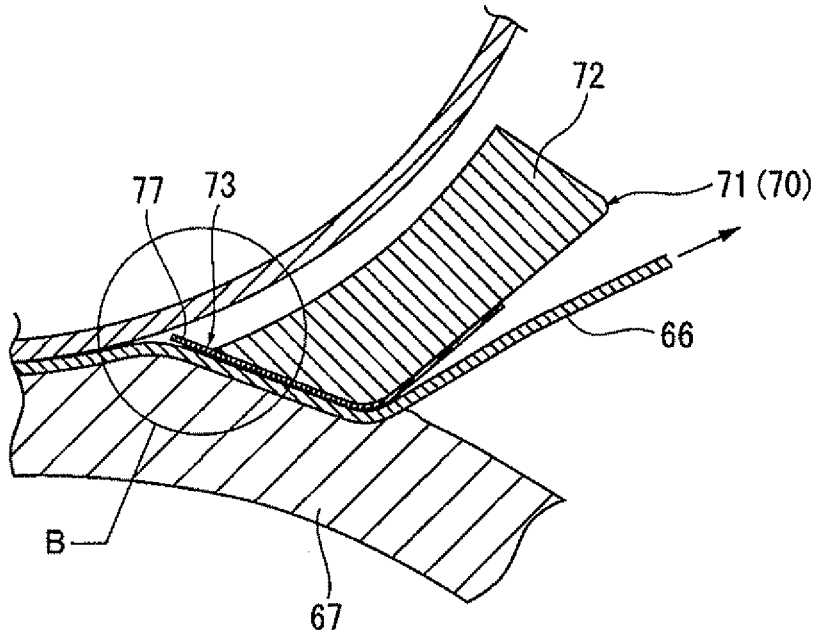
FIG. 13A is an explanatory view showing the outline of a mode where a pressure pad additionally provided with a protrusion portion is used in the first embodiment.
Figure 13B:
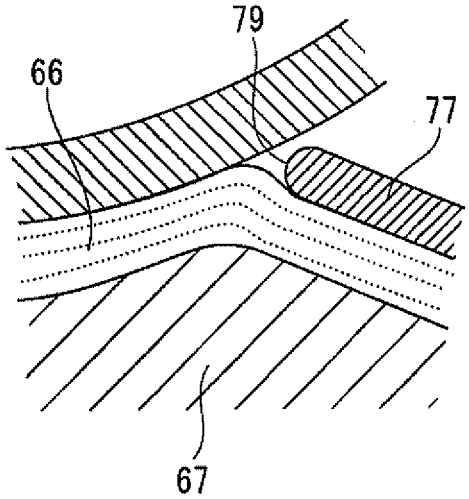
FIG. 13B is an explanatory view showing the details of a portion B in FIG. 13A when the protrusion portion has a curved sectional shape in its tip.

Further, the protrusion portion 77 is formed as a curved end 79 having a sectionally curved tip (see FIG. 13B).

Figure 6A:
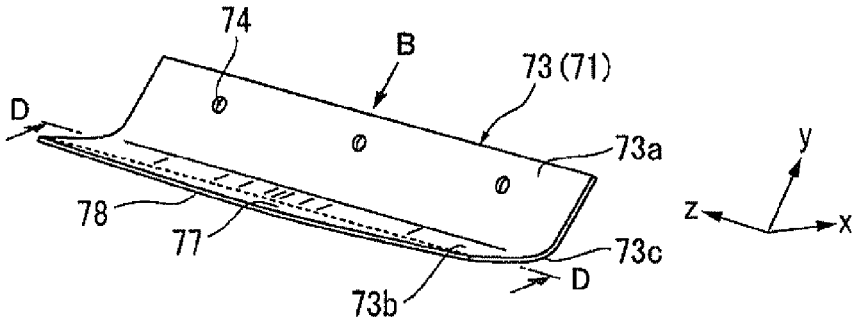
FIG. 6A is a perspective view of a separation member which is a component of the pressure pad.
Figure 6B:
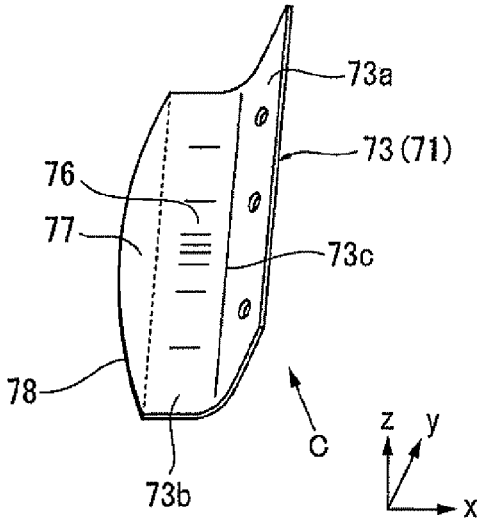
FIG. 6B is a view taken in the direction of the arrow B in FIG. 6A.
Figure 6C:
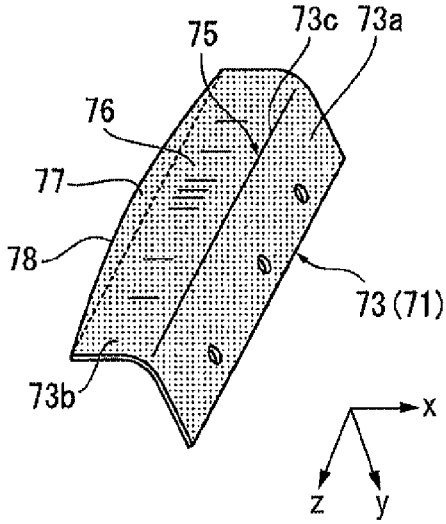
FIG. 6C is a view taken in the direction of the arrow C in FIG. 6B.
Figure 6D:
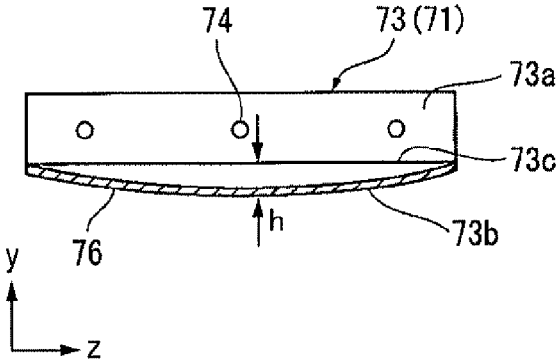
FIG. 6D is a sectional view taken on line D-D in FIG. 6A.
Figure 6E:
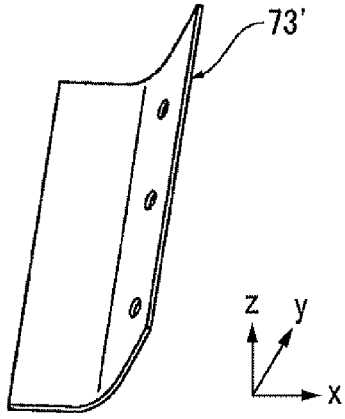
FIG. 6E is a perspective view showing a separation member according to a comparative mode, which indicate the reference symbol X, Y and Z for three space axis directions (X axis direction, Y axis direction and Z axis direction) respectively in the drawings.

In this manner, in this embodiment, the separation member 73 which is a component of the pressure pad 71 is characterized by including the guide portion 75, the pressure portion 76 and the protrusion portion 77, as compared with a separation member 73' (which is formed by bending a substantially rectangular flat plate into a substantially sectionally L-shape) in a comparative mode shown in FIG. 6E.

Figure 7A:
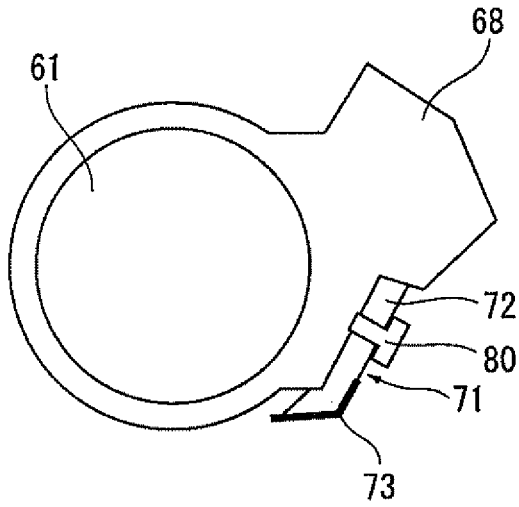
FIG. 7A is an explanatory view showing an example of a mounting structure of the pressure pad of the separation unit.

This embodiment provides a mounting structure of the separation unit 70 as shown in FIG. 7A, in which a fixing holder 68 holding the fixing roll 61 is fixed to a not-shown image forming apparatus housing, and the supported member 72 which is a component of the pressure pad 71 is fixed to the fixing holder 68 by a support member 80.

The mounting structure of the separation unit 70 is not limited thereto. For example, as shown in FIG. 7B, the supported member 72 which is a component of the pressure pad 71 may be fixed to a support member 81 which is swingably supported on a shaft of the fixing roll 61, while the supported member 72 is urged in a direction against the swinging direction of the support member 81 by an urging spring 82.

Figure 7B:
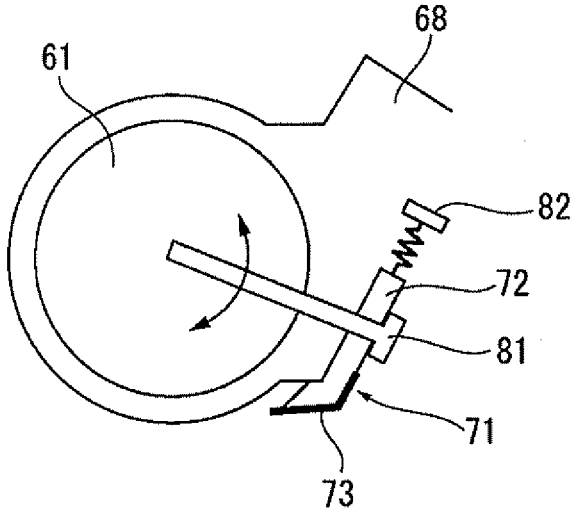
FIG. 7B is an explanatory view showing another example of the mounting structure.

As for the mounting structure of the separation unit 70, the system shown in FIG. 7A is preferred to the system shown in FIG. 7B in that the relative range relation of the pressure pad 71 of the separation unit 70 to the pressure roll 67 is uniquely decided.

Although the embodiment has been described in the case where the fixing unit 60 has the separation unit 70 provided inside the heating belt 66, a separation assistant member 90 may be provided on the downstream side of the fixing nip area N between the heating belt 66 and the pressure roll 67 in the fixing unit 60.

The separation assistant member 90 is disposed in the rotating direction of the heating belt 66 so that a tip portion of the separation assistant member 90 can face the heating belt 66 in a noncontact manner while separating the sheet of paper P adhering to the heating belt 66. For example, a plate-like baffle board is used as the separation assistant member 90.

The separation assistant member 90 is preferably provided so that the tip thereof is as close to the heating belt 66 as possible. The setting distance between the separation assistant member 90 and the heating belt 66 is made not longer than at least 1.0 mm, preferably not longer than 0.3 mm.

However, if the separation assistant member 90 is set too closely to the heating belt 66, there is fear that the separation assistant member 90 may be thermally expanded by radiant heat from the heating belt 66, and there is also fear that the separation assistant member 90 may further damage the heating belt 66 or wave the heating belt 66, to thereby cause a defect in an image. In this embodiment, it is therefore preferable that a raw material with low thermal expansion (e.g. Invar) is used as the separation assistant member 90.

Next, description will be made on the operation of the image forming apparatus according to this embodiment.

In the image forming apparatus shown in FIG. 2, color component toner images are formed on the photoconductors 30 by color component image forming portions 22 (22*a* to 22*d*) respectively. The color toner images are primarily transferred sequentially onto the intermediate transfer member 23. After that, the color toner images on the intermediate transfer member 23 are transferred in a lump onto a sheet of paper P supplied from the paper feed unit 50. The sheet of paper P holding the color toner images transferred in a lump is conveyed to the fixing unit 60. The color toner images are fixed onto the sheet of paper P by the fixing unit 60. Then, the sheet of paper P on which the color toner images have been fixed is discharged from the fixing unit 60.

In such an image forming process, an operating process of the separation unit 70 of the fixing unit 60 will be described.

Figure 8A:
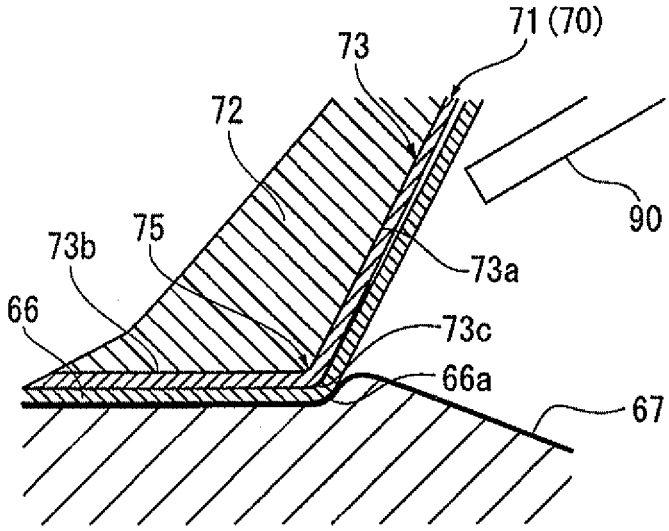
FIG. 8A is an explanatory view schematically showing a relative position relationship between the pressure pad of the separation unit and a pressure roll.

In this embodiment, as shown in FIG. 8A, the separation unit 70 uses the guide portion 75 of the pressure pad 71 to guide the heating belt 66 so that the heating belt 66 can bite into the pressure roll 67.

Particularly in this embodiment, the guide portion 75 of the pressure pad 71 is designed to allow the heating belt 66 to bite into the pressure roll 67 so that a bent portion 66*a* of the heating belt 66 disposed to be bent correspondingly to the curved angle portion 73*c* of the separation member 73 can be buried into the pressure roll 67. Thus, the distribution of pressure applied between the heating belt 66 and the pressure roll 67 by the pressure pad 71 (corresponding to the distribution of pressure in the nip area $N_2$ shown in FIG. 4) shows that pressure acts substantially uniformly between the lateral wall portion 73*b* and the curved angle portion 73*c* of the separation member 73 with respect to a position in the process-direction corresponding to the moving direction of the sheet of paper P as shown in FIG. 8B.

Figure 8B:
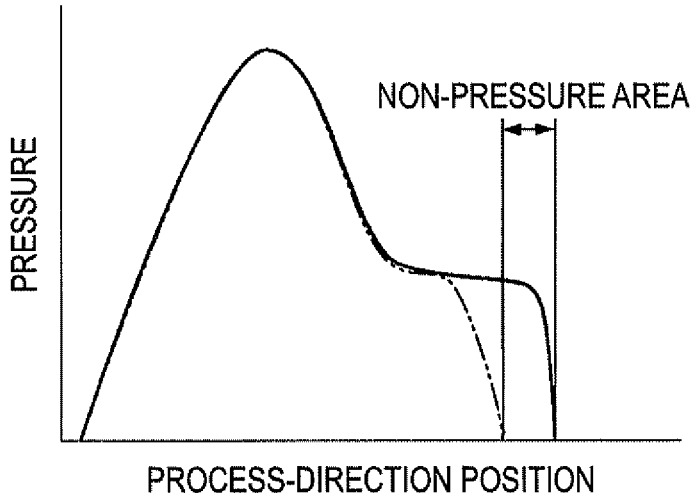
FIG. 8B is an explanatory view showing a relationship between a process-direction position of the pressure pad and pressure applied thereby.

The distribution of pressure shown in FIG. 8B shows a distribution of pressure in the fixing nip area N in FIG. 4, in which the left area corresponds to the nip area $N_1$ and the right area corresponds to the nip area $N_2$.

Figure 9A:
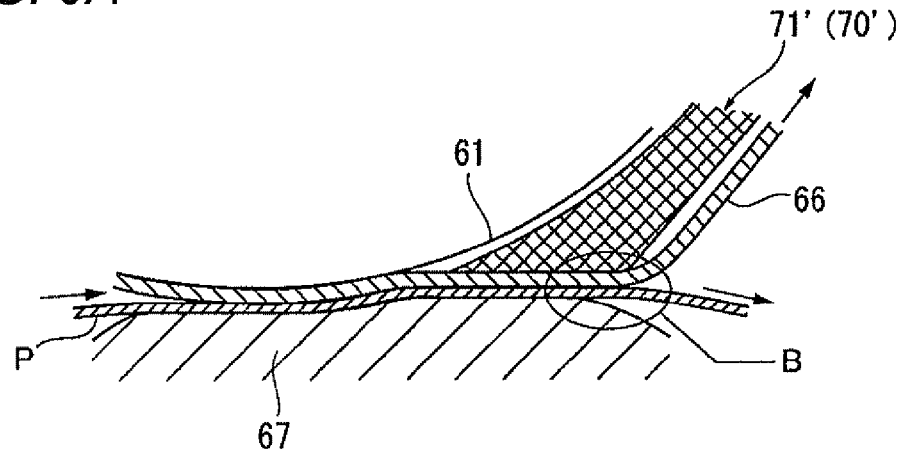
FIG. 9A is an explanatory view showing the outline of a comparative mode in which a pressure pad of a separation unit can be prevented from biting into a pressure roll.
Figure 9B:
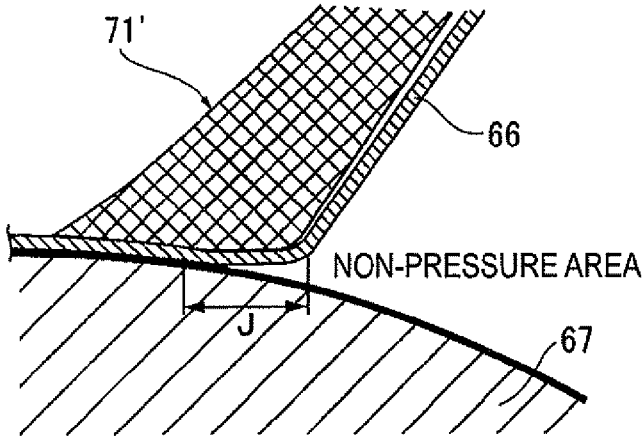
FIG. 9B is an explanatory view in which a portion B in FIG. 9A is enlarged.

With respect to this point, if a pressure pad 71' which is a component of a separation unit 70' pressed the heating belt 66 without biting therein as in a comparative mode shown in FIG. 9A, there would be fear that a non-pressure area J where the heating belt 66 could not be pressurized by the pressure roll 67 might be produced between the pressure pad 71' and the pressure roll 67 as shown in FIG. 9B.

Figure 9C:
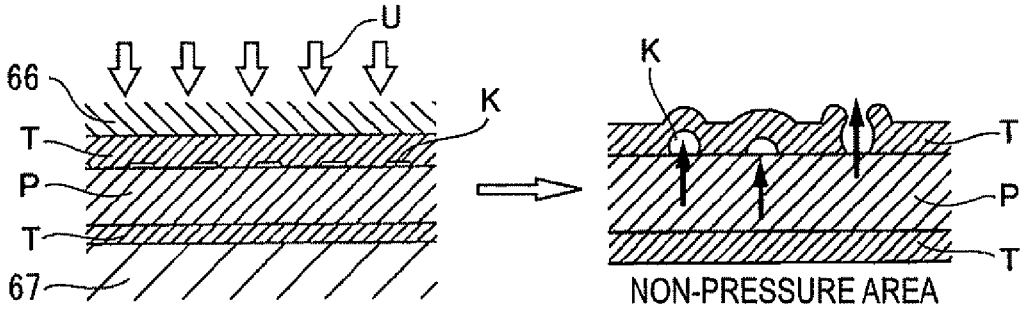
FIG. 9C is an explanatory view schematically showing a phenomenon appearing in a non-pressure area in FIG. 9B.

On this occasion, when the heating belt 66 is pressurized by the pressure roll 67, a toner layer T on the sheet of paper P is pressurized by the heating belt 66 as shown in FIG. 9C, so that the relationship of pressing force U> vapor pressure in bubbles K in the toner layer T can be satisfied even if the bubbles K want to expand. Thus, the bubbles K in the toner layer T can be kept as they are.

On the other hand, if the non-pressure area J were present as described above, there would be fear that the bubbles in the toner layer T might be expanded to establish the relationship of pressing force U< vapor pressure in bubbles K, to thereby cause a phenomenon that the expanded bubbles K might break the toner layer T to disturb the surface of the toner layer T, as shown in FIG. 9C.

Accordingly, the presence of the aforementioned non-pressure area J can be prevented according to the embodiment so that the phenomenon that the expanded bubbles K might break the toner layer T can be suppressed.

Figure 10A:
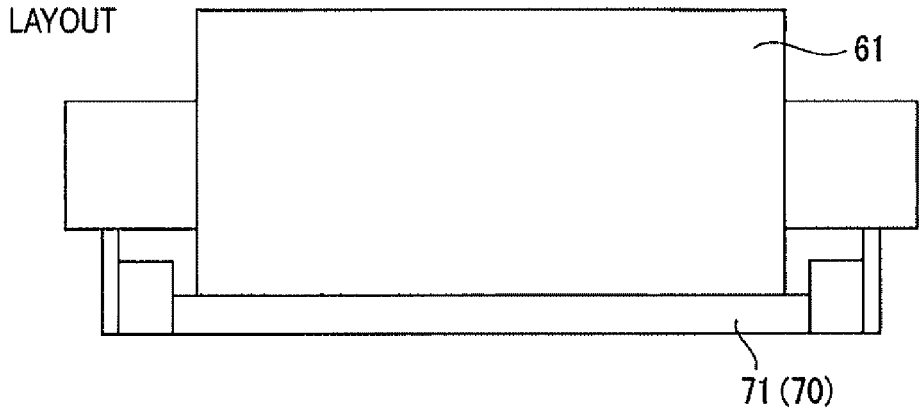
FIG. 10A is an explanatory view schematically showing the layout of the fixing unit viewed from above.

FIG. 10A is a schematic view in which the fixing unit 60 used in this embodiment is viewed from above.

Figure 10B:
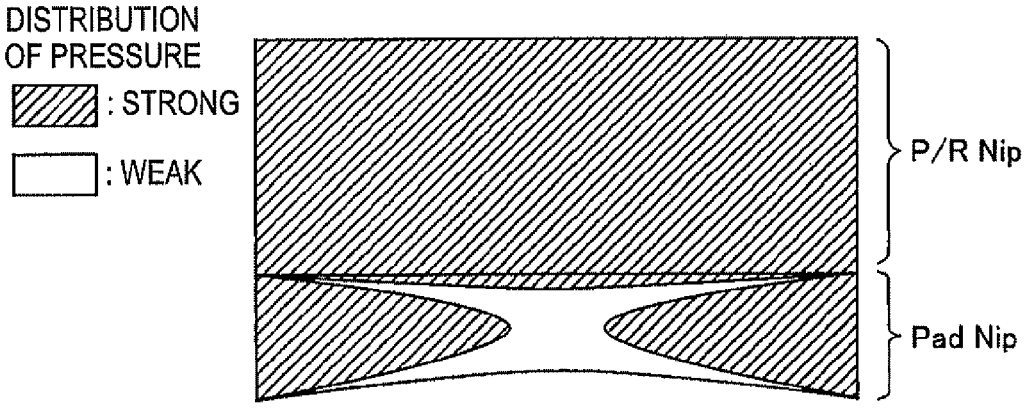
FIG. 10B is an explanatory view schematically showing a distribution of pressure in a fixing nip area in a mode where the pressure pad of which a pressure area is formed as a flat is used.

On this occasion, when the pressure portion 76 is absent from the pressure pad 71 of the separation unit 70 (corresponding to a mode where the pressure portion is formed as a flat), in the distribution of pressure in the fixed nip area N as shown in FIG. 10B, sufficiently strong pressure can be obtained in the nip area $N_1$ shown in FIG. 4 (corresponding to P/R Nip in FIG. 10B), but in the nip area $N_2$ shown in FIG. 4 (corresponding to Pad Nip in FIG. 10B), there can be observed a tendency that pressure in a center portion in the direction of the paper width crossing the process direction is weaker than pressure in any of opposite end portions.

In such circumstances, in this embodiment, the pressure portion 76 of the pressure pad 71 has a surface which separates sequentially from the pressure roll 67 with respect to a direction of the paper width from the center portion of the pressure portion 76 to the end portion of the pressure portion 76.

Figure 10C:
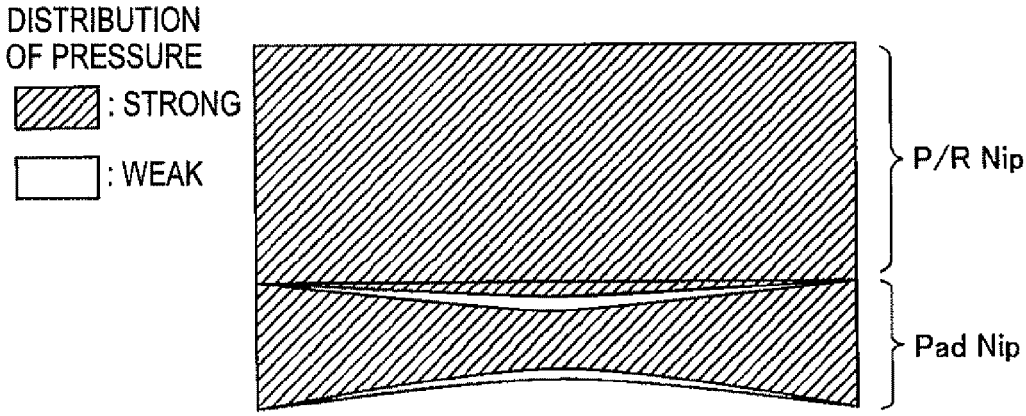
FIG. 10C is an explanatory view schematically showing a distribution of pressure in a mode where a pressure pad which is additionally provided with a pressure portion of the first embodiment is used.

Accordingly, in the distribution of pressure in the fixed nip area N, a shortage of pressure in the center portion is compensated in the nip area $N_2$ (corresponding to Pad Nip in FIG. 10C) corresponding to the pressure pad 71 so that the pressure in the center portion of the nip area $N_2$ in the direction of the paper width can be made substantially equal to the pressure in any of the opposite end portions thereof. Thus, the toner layer T in the sheet of paper P is heated and fixed with a substantially uniform distribution of pressure even in the nip area $N_2$ of the fixing nip area N. As a result, the fixing performance of the toner layer T onto the sheet of paper P can be kept substantially uniform with respect to the direction of the paper width.

In this embodiment, the pressure pad 71 has a protrusion portion 77 which is formed to protrude in a convex shape in which a center portion thereof in the direction of the paper width is more protrusive toward the nip area $N_1$ than any of opposite end portions thereof. Accordingly, the pressurizing area of the widthwise center portion of the pressure pad 71 increases due to the protrusion portion 77. Thus, the distribution of pressure applied by the pressure pad 71 has a tendency to increase in a portion corresponding to the protrusion portion 77 as shown in FIG. 11A.

Figure 11B:
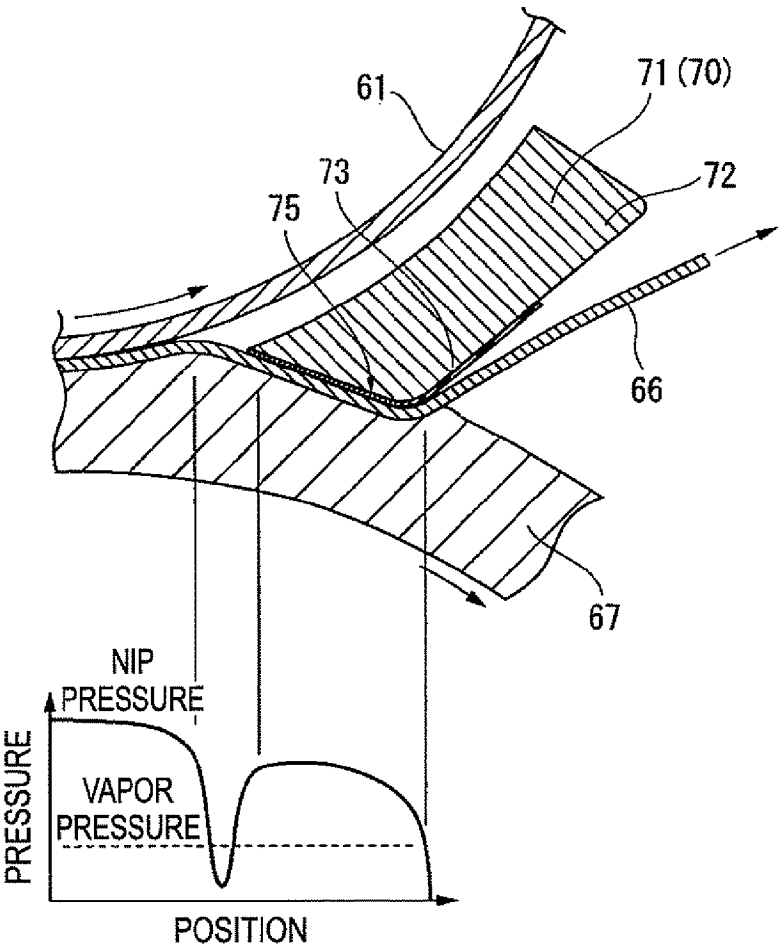
FIG. 11B is an explanatory view schematically showing a mode where a pressure pad having no protrusion portion is used.
Figure 11A:
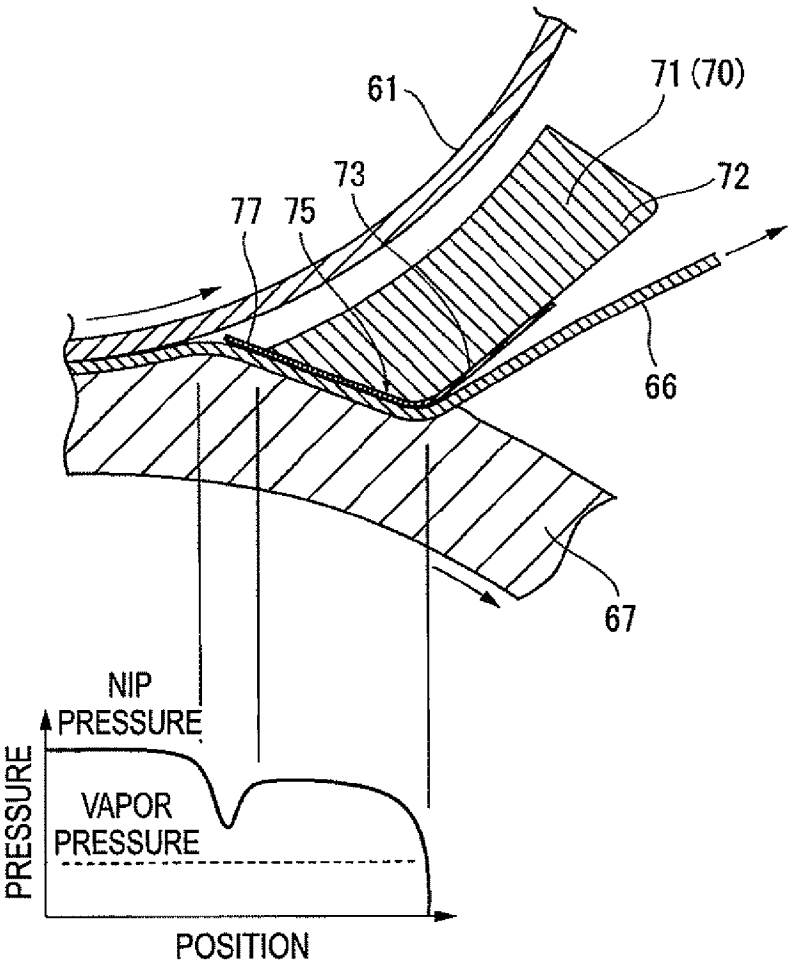
FIG. 11A is an explanatory view schematically showing a distribution of pressure in a mode where a pressure pad additionally provided with a protrusion portion is used.

Particularly in this embodiment, the distribution of pressure applied by the pressure pad 71 has a higher pressing force (nip pressure) than the vapor pressure of bubbles in a portion corresponding to the protrusion portion 77 as shown in FIG. 11A. Thus, the toner layer is hardly broken due to the expansion of the bubbles in the portion corresponding to the protrusion portion 77.

With respect to this point, if the protrusion portion 77 were absent from the pressure pad 71, no pressing force would act on the portion corresponding to the protrusion portion 77 of the pressure pad 71. Thus, as shown in FIG. 11B, there would be fear that a non-pressure area (pressing force<vapor pressure of bubbles) where pressure would be hardly applied might be formed on the pressure roll 67 side between the pressure pad 71 and the fixing roll 61.

Figure 12A:
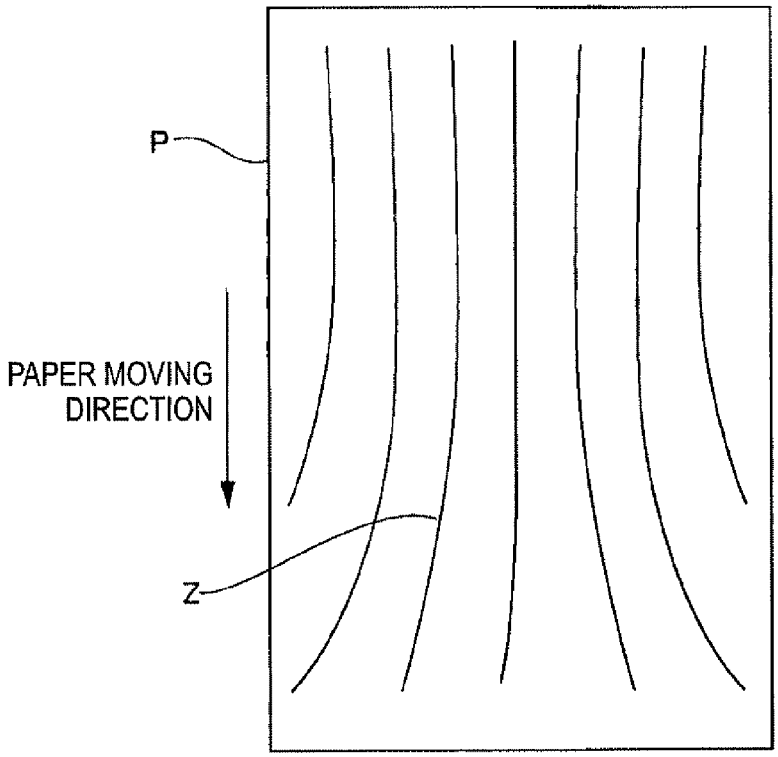
FIG. 12A is an explanatory view showing an example of a state where a sheet of paper passing through a fixing nip area is conveyed.

When the sheet of paper P passes through the fixing nip area N (see FIG. 4) of the fixing unit 60, creases Z are produced easily in the sheet of paper P as shown in FIG. 12A.

Figure 12B:
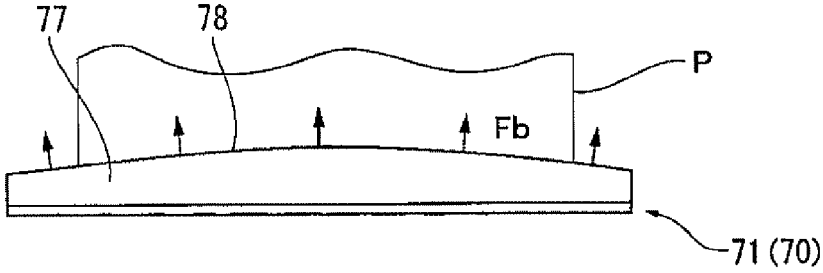
FIG. 12B is an explanatory view showing action on a sheet of paper in a mode where a pressure pad additionally provided with a protrusion portion is used in the first embodiment.

In this embodiment, a tip edge of the protrusion portion 77 of the pressure pad 71 is formed as a curved edge 78 which is symmetrical and curved around the widthwise center portion of the sheet of paper P so that a force Fb to spread the sheet of paper P in the normal direction of the curved edge 78 can act on the curved edge 78 of the protrusion portion 77 as shown in FIG. 12B. Thus, the creases Z of the sheet of paper P are spread to be hardly produced.

Figure 12C:
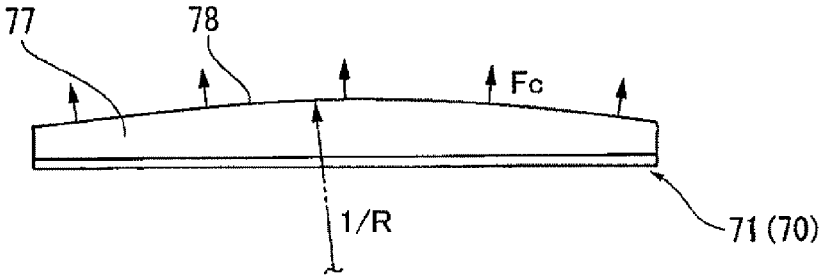
FIG. 12C is an explanatory view showing a change of action on a sheet of paper in a mode where the curvature of a curved surface of a tip of the protrusion portion is changed.

Particularly when the curvature (1/R) of the curved edge 78 of the protrusion portion 77 is set to be large, the effect to spread the sheet of paper P by a force Fc in the normal direction of the curved edge 78 will be enhanced as shown in FIG. 12C, as compared with the case where the curvature is small.

In this embodiment, the tip of the protrusion portion 77 is formed as a curved end 79 having a sectionally curved shape as shown in FIGS. 13A and 13B. As a result, even when the heating belt 66 moving from the fixing roll 61 and along the pressure pad 71 of the separation unit 70 wants to enter between the fixing roll 61 and the curved end 79 of the protrusion portion 77 of the pressure pad 71, the heating belt 66 is introduced toward the pressing surface of the pressure pad 71 along the curved end 79 of the protrusion portion 77. Thus, there is no fear that the heating belt 66 may be caught on the tip of the protrusion portion 77 of the pressure pad 71.

Figure 13C:
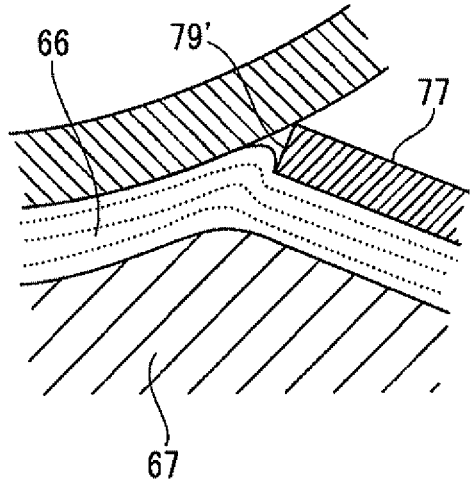
FIG. 13C is an explanatory view showing the details of the portion B in FIG. 13A when the protrusion portion has a flat sectional shape in its tip.

With respect to this point, if the tip of the protrusion portion 77 of the pressure pad 71 were formed as a flat end 79' having a sectionally flat surface as shown in FIG. 13C, there would be fear that the heating belt 66 might be easily caught in a gap between the fixing roll 61 and the flat end 79' of the protrusion portion 77.

In this embodiment, the pressure pad 71 of the separation unit 70 presses the heating belt 66 onto the pressure roll 67. Therefore, when it is necessary to increase the pressing force by the pressure pad 71 to some extent, the frictional resistance between the pressure pad 71 and the heating belt 66 tends to increase.

Figure 14A:
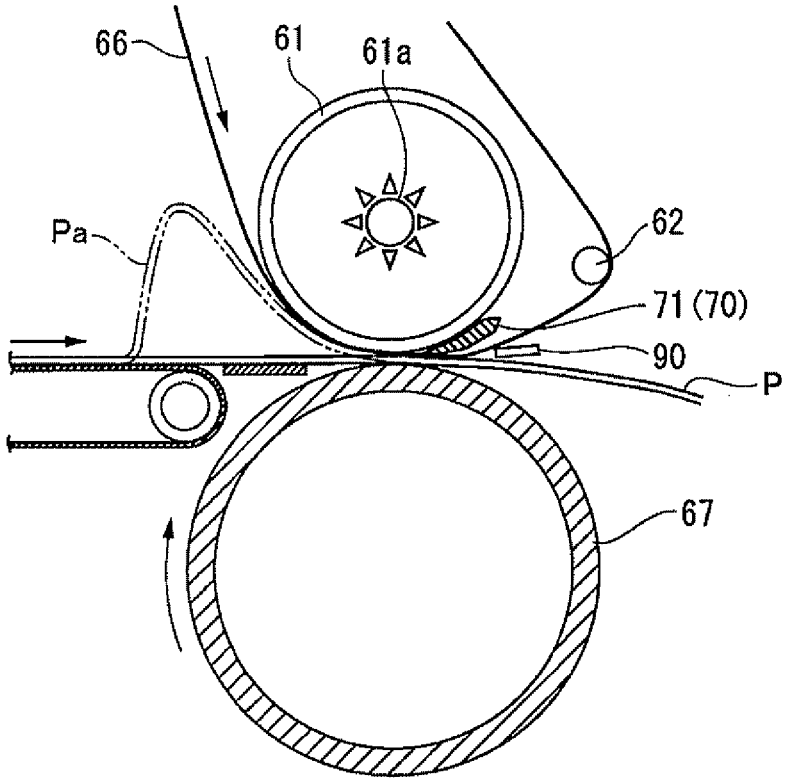
FIG. 14A is an explanatory view schematically showing the circumstance where the conveyance operation of a fixing belt becomes unstable.

In such circumstances, if the frictional resistance between the pressure pad 71 and the heating belt 66 increased unnecessarily, there would be fear that the moving velocity of the heating belt 66 would be so unstable that the conveyance performance of the sheet of paper P might be impaired, for example, due to a loop Pa produced when the sheet of paper P enters the fixing nip area N as represented by a virtual line in FIG. 14A.

Figure 14B:
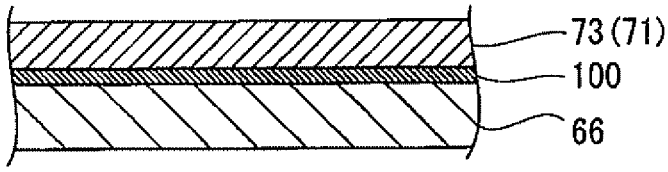
FIG. 14B is an explanatory view showing an example of a surface configuration of a separation member which is a component of the pressure pad.
Figure 15A:
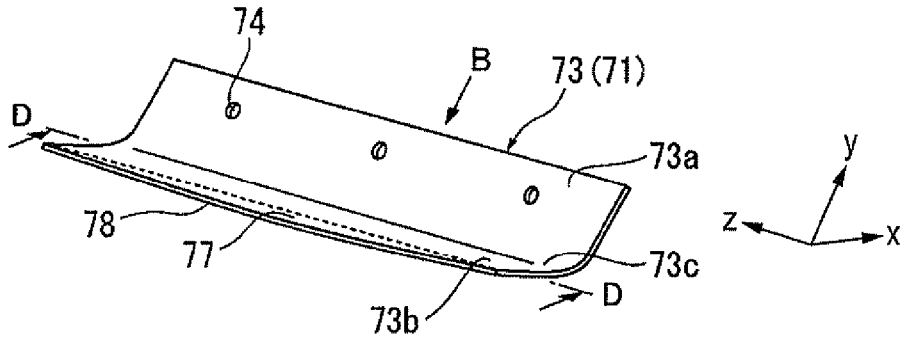
FIG. 15A is a perspective view showing a separation member which is a component of a pressure pad used in a second embodiment.
Figure 15B:
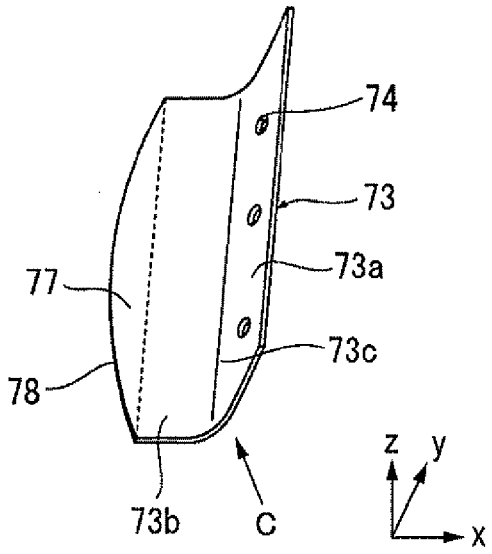
FIG. 15B is a view taken in the direction of the arrow B in FIG. 15A.
Figure 15C:
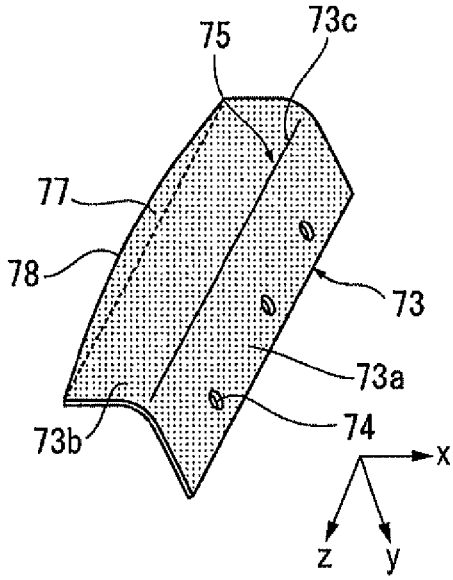
FIG. 15C is a view taken in the direction of the arrow C in FIG. 15B.
Figure 15D:
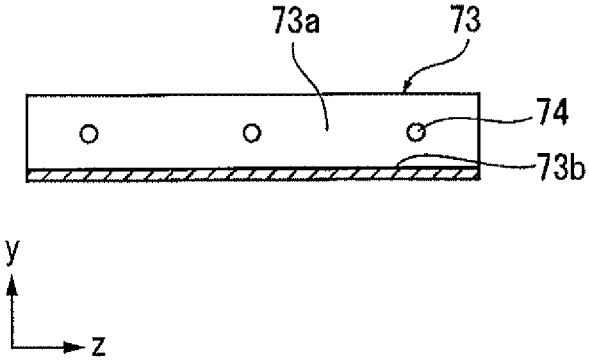
FIG. 15D is a sectional view taken on line D-D in FIG. 15A, which indicate the reference symbol X, Y and Z for three space axis directions (X axis direction, Y axis direction and Z axis direction) respectively in the drawings.

In such a case, it is preferable that a lubricating layer 100 of glass fiber or the like is formed in the contact plane between the separation member 73, which is a component of the pressure pad 71, and the heating belt 66 as shown in FIG. 14B, so that the frictional resistance between the pressure pad 71 and the heating belt 66 can be reduced.

Second Embodiment

FIGS. 15A to 15D show a main portion of a separation unit used in the second embodiment.

In FIGS. 15A to 15D, the fundamental configuration of the separation unit 70 is substantially the same as that in the first embodiment, except the separation member 73 which is a component of the pressure pad 71.

In this embodiment, the separation member 73 which is a component of the pressure pad 71 has the guide portion 75 and the protrusion portion 77 in the same manner as in the first embodiment, but does not have the pressure portion 76 of the first embodiment.

According to this embodiment, the pressure pad 71 has the guide portion 75 and the protrusion portion 77 so that a shortage of pressure in the center portion in the paper width direction can be compensated in the distribution of pressure applied by the pressure pad 71. Thus, the pressure in the center portion in the paper width direction is adjusted to approach the pressure in any of the opposite end portions.

Also in this embodiment, the protrusion portion 77 of the pressure pad 71 has an effect to spread a sheet of paper P when the sheet of paper P is passing through there. Thus, production of creases in the sheet of paper P can be suppressed.

According to any of the aforementioned embodiments, the pressure pad 71 of the separation unit 70 has the guide portion 75, by which the heating belt 66 is guided to bite into the pressure roll 67. For example, however, even in a mode where the guide portion 75 is absent from the pressure pad 71, a protrusion portion 77 similar to that according to the first or second embodiment may be added. In such a case, the protrusion portion 77 of the pressure pad 71 has an effect to spread the sheet of paper P when the sheet of paper P is passing through there. Thus, the production of creases in the sheet of paper P can be suppressed.

A fixing unit (using the separation unit 70) according to the first embodiment was used in Example, in which the relationship between a process-direction position and pressure in the fixing nip area N (see FIG. 4) was examined.

On the other hand, a mode in which a guide portion, a pressure portion and a protrusion portion were absent as a pressure pad of a separation unit in a fixing unit according to the first embodiment was used in Comparative Example, in which the relationship between a process-direction position and pressure in the fixing nip area N (see FIG. 4) was examined.

Figure 16A:
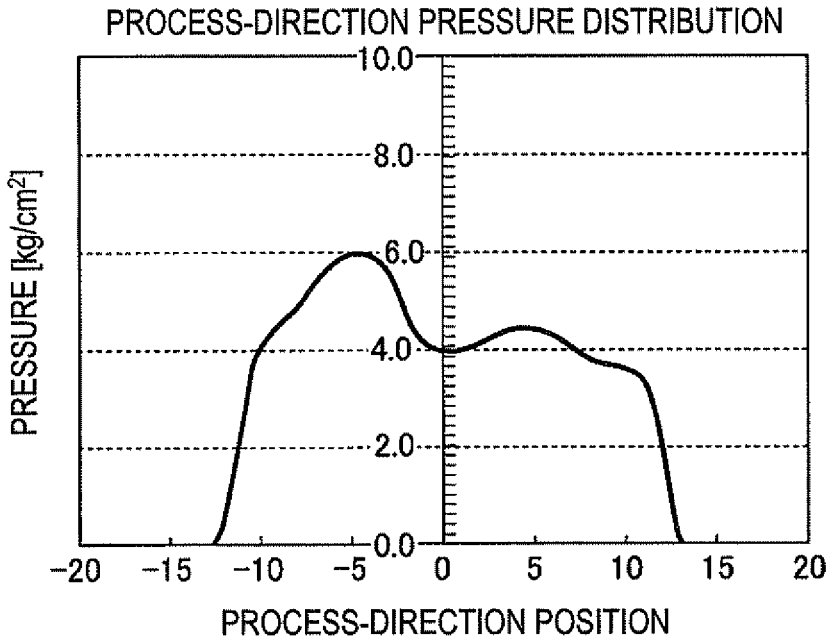
FIG. 16A is an explanatory view showing an example of a distribution of pressure in a fixing nip area when a separation unit according to Example is used.

It can be understood that the distribution of pressure in the fixing nip area N in Example shows a substantially uniform pressure in the nip area $N_2$ (see FIG. 4) corresponding to the pressure pad as shown in FIG. 16A.

Figure 16B:
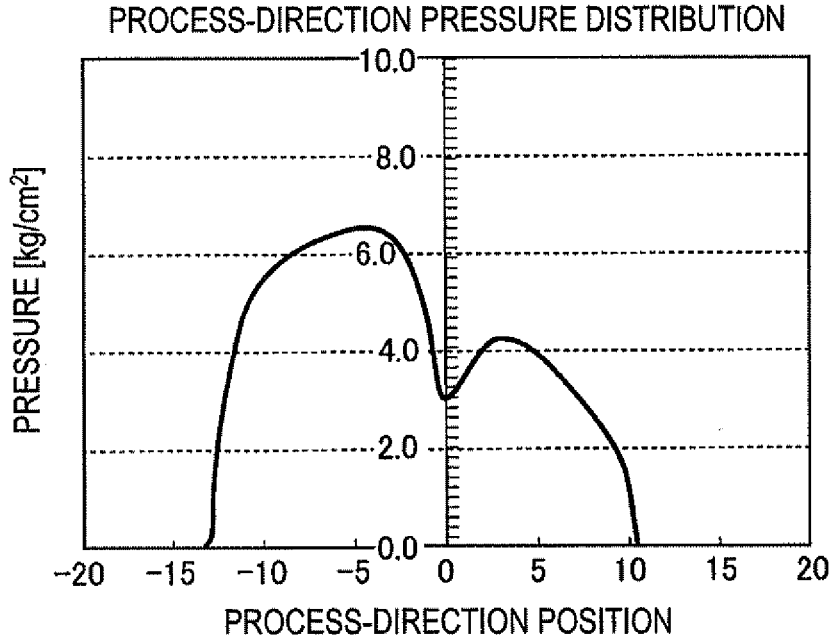
FIG. 16B is an explanatory view showing an example of a distribution of pressure in a fixing nip area when a separation unit according to Comparative Example is used.

On the other hand, it can be understood that the distribution of pressure in the fixing nip area N in Comparative Example shows that a non-pressure area is present in the nip area $N_2$ (see FIG. 4) corresponding to the pressure pad and there is a portion short of pressure, as shown in FIG. 16B.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A separation unit which is provided on a downstream side of a contact area between a belt-like rotating body and a pressure rotating body disposed in contact with the belt-like rotating body so as to apply elastic pressure thereto, and which separates a recording material disposed adjacently to the contact area inside the belt-like rotating body and adhering to the belt-like rotating body, the separation unit comprising:

a pressure member that is provided to extend along a width direction of the belt-like rotating body, the width direction crossing a moving direction of the belt-like rotating body, and that presses the belt-like rotating body so as to deform the belt-like rotating body into a bent shape changing a course of the belt-like rotating body away from a surface of the pressure rotating body after the belt-like rotating body is disposed in contact with the pressure rotating body;

a guide portion that is provided on the pressure rotating body side of the pressure member and that guides the belt-like rotating body so that an angle portion of the bent shape of the belt-like rotating body bites into the pressure rotating body; and a pressure portion that is provided on the surface of the pressure member in the pressure rotating body side, wherein the pressure portion is provided so that the surface of the pressure member separates sequentially from the pressure rotating body in the extending direction of the pressure member from a center portion of the pressure portion to an end portion of the pressure portion.

2. The separation unit according to claim 1, further comprising:

a protrusion portion that is provided on the pressure rotating body side of the pressure member and on the contact area side between the belt-like rotating body and the pressure rotating body, so as to protrude in a convex shape in which a center portion thereof is more protrusive toward the contact area than any of opposite end portions thereof with respect to a crossing direction crossing the moving direction of the belt-like rotating body.

3. The separation unit according to claim 1, wherein the pressure member includes a supported member and a separation member, the supported member being supported on a predetermined support portion, the separation member being provided along a contact plane between the supported member and the belt-like rotating body.

4. The separation unit according to claim 3, wherein the pressure member is fixedly supported to a holding member which is held by the belt-like rotating body through a support member.

5. The separation unit according to claim 1, wherein a contact surface of the pressure member with the belt-like rotating body has a lubricating layer which reduces a frictional force between the contact surface and the belt-like rotating body.

6. The separation unit according to claim 1, wherein the angle portion of the bent shape of the belt-like rotating body has a curved portion with a large curvature, and the guide portion makes the belt-like rotating body bite into the pressure rotating body so that the curved portion of the belt-like rotating body is buried therein.

7. The separation unit according to claim 2, wherein the protrusion portion is formed to be symmetrical with respect to the center portion in the crossing direction and to be curved.

8. The separation unit according to claim 2, wherein the protrusion portion is formed to have a sectionally curved tip.

9. A fixing unit comprising:

a belt-like heating rotating body that rotates while at least its surface is heated;

a pressure rotating body (i) that is brought into pressure contact with a surface of the heating rotating body, (ii) that rolls together with the heating rotating body, (iii) that conveys a recording material while holding the recording material between the pressure rotating body and the heating rotating body, and (iv) that heats, pressurizes and fixes an unfixed toner image on the recording material; and the separation unit according to claim 1, that separates the recording material adhering to at least the heating rotating.

10. An image forming apparatus comprising:

a toner image forming unit that forms an unfixed toner image on a recording material; and the fixing unit according to claim 9, that fixes the unfixed toner image formed on the recording material by the toner image forming unit.

11. A separation unit which is provided on a downstream side of a contact area between a belt-like rotating body and a pressure rotating body disposed in contact with the belt-like rotating body so as to apply elastic pressure thereto, and which separates a recording material disposed adjacently to the contact area inside the belt-like rotating body and adhering to the belt-like rotating body, the separation unit comprising:

a pressure member that is provided to extend along a width direction of the belt-like rotating body, the width direction crossing a moving direction of the belt-like rotating body, and that presses the belt-like rotating body so as to deform the belt-like rotating body into a bent shape changing a course of the belt-like rotating body away from a surface of the pressure rotating body after the belt-like rotating body is disposed in contact with the pressure rotating body;

a guide portion that is provided on the pressure rotating body side of the pressure member and that guides the belt-like rotating body so that an angle portion of the bent shape of the belt-like rotating body bites into the pressure rotating body; and a protrusion portion that is provided on the pressure rotating body side of the pressure member and on the contact area side between the belt-like rotating body and the pressure rotating body, so as to protrude in a convex shape in which a center portion thereof is more protrusive toward the contact area than any of opposite end portions thereof with respect to a crossing direction crossing the moving direction of the belt-like rotating body and extends away from the pressure member.

12. The separation unit according to claim 11, wherein the protrusion portion is formed of a continuous arc shape from the center portion toward the respective end portions.

* * * * *